United States Patent [19]

Fenner, Sr.

[11] Patent Number: 5,031,261

[45] Date of Patent: Jul. 16, 1991

[54] MATTRESS OVERLAY FOR AVOIDANCE OF DECUBITUS ULCERS

[75] Inventor: William G. Fenner, Sr., Richmond, Va.

[73] Assignee: E. R. Carpenter Company, Inc., Richmond, Va.

[21] Appl. No.: 493,124

[22] Filed: Mar. 15, 1990

[51] Int. Cl.[5] ..... A47C 27/14

[52] U.S. Cl. ..... 5/481

[58] Field of Search ..... 5/446, 448, 464, 481

[56] References Cited

U.S. PATENT DOCUMENTS

| | | | |
|---|---|---|---|
| Re. 32,734 | 8/1988 | McLeod | 5/464 |
| D. 174,812 | 5/1955 | Haller . | |
| 2,371,788 | 3/1945 | Weeber . | |
| 2,785,739 | 3/1957 | McGregor, Jr., et al. . | |
| 2,902,091 | 9/1959 | Dahle . | |
| 3,047,888 | 8/1962 | Shecter et al. . | |
| 3,051,601 | 8/1962 | Schick . | |
| 3,118,153 | 1/1964 | Hood . | |
| 3,197,357 | 7/1965 | Schulpen . | |
| 3,553,749 | 1/1971 | Majeske | 5/481 X |
| 3,846,857 | 11/1974 | Weinstock | 5/465 |
| 3,885,257 | 5/1975 | Rogers . | |
| 3,939,508 | 2/1976 | Hall et al. . | |
| 4,070,719 | 1/1978 | Morgan . | |
| 4,178,161 | 12/1979 | Rudner et al. . | |
| 4,190,697 | 2/1980 | Ahrens | 5/481 X |
| 4,276,666 | 7/1981 | Yamada . | |
| 4,320,543 | 3/1982 | Dixon . | |
| 4,580,301 | 4/1986 | Ludman et al. . | |
| 4,603,445 | 8/1986 | Spann . | |
| 4,605,582 | 8/1986 | Sias et al. . | |
| 4,620,337 | 11/1986 | Williams et al. . | |
| 4,673,452 | 6/1987 | Awdhan . | |
| 4,678,724 | 8/1987 | Bedford | 5/481 X |
| 4,700,447 | 10/1987 | Spann | 29/418 |
| 4,741,058 | 5/1988 | Williams et al. . | |
| 4,768,251 | 9/1988 | Baskent . | |
| 4,816,494 | 3/1989 | Watson, Jr. et al. . | |
| 4,868,724 | 8/1989 | Bedford . | |
| 4,868,725 | 8/1989 | Mitchell . | |
| 4,879,776 | 11/1989 | Farley | 5/481 X |

FOREIGN PATENT DOCUMENTS

| | | | |
|---|---|---|---|
| 1729995 | 8/1971 | Fed. Rep. of Germany . | |
| 1281638 | 5/1962 | France . | |
| 526407 | 5/1955 | Italy . | |
| 1257962 | 12/1971 | United Kingdom | 5/481 |

OTHER PUBLICATIONS

Omalux (TM) Foam Material Brochure—a product of E. R. Carpenter Company, Inc. (date unknown).

Journal For Extended Patent Care Management, Ostomy/Wound Management, vol. 26 Jan./Feb. 1990 (pp. 39–44).

*Primary Examiner*—Michael F. Trettel

*Attorney, Agent, or Firm*—Beveridge, DeGrandi & Weilacher

[57] ABSTRACT

A laminated foam mattress overlay for preventing the formation of decubitus ulcers in bedridden individuals. The mattress overlay includes an upper layer of polyurethane foam laminated to a base layer of a different polyurethane foam. The upper lay features a polyurethane foam which is of a higher density than the base layer. The upper layer also includes a higher initial softness ratio than the base layer. The base layer has higher 5, 25 and 65% indentation load deflection values (ILD) than the corresponding ILD values for the upper layer which is attributable to the firmer support provided by the foundation or base layer. The base layer is preferably thicker than the upper layer which can include a checkerboard-like upper surface. The combination of layers provides for a reduction in pressure points in the areas of greatest concern such as the hip and heel. The combination of layers work together to provide firm, comfortable support while distributing loads in the high risk areas of the body to help in avoiding the formation of ulcers.

29 Claims, 3 Drawing Sheets

MATTRESS OVERLAY FOR AVOIDANCE OF DECUBITUS ULCERS

FIELD OF THE INVENTION

This invention relates to a mattress overlay for avoiding formation of decubitus ulcers. More particularly, the present invention is directed at a laminated foam mattress overlay which avoids tissue trauma.

BACKGROUND OF THE INVENTION

For patients and other persons restricted to bed for extended periods of time, there arises the possibility of decubitus ulcers forming. Decubitus ulcers (also referred to as bed sores, pressure sores or pressure ulcers) are formed due to an interruption of blood flow in the capillaries below skin tissue due to pressure against the skin.

The highest risk areas for such ulcers to form are those areas where there exists a bony prominence which tends to shut down capillaries sandwiched between the bony prominence and the underlying support surface. When considering the redistribution of body weight and the formation of decubitus ulcers, the trochanter (hip) and the heels are the body sites of greatest concern since these two areas are most frequently involved in decubitus ulcer formations.

Blood flows through the capillaries at approximately 32 millimeters of mercury pressure (mm Hg). This level can be somewhat lower for elderly individuals or individuals with poor health or nutritional deficiencies. Thus, for the most part, once an external pressure exceeds 32 mm Hg, capillary occlusion occurs and the capillaries no longer supply oxygen and nutrition to the skin. Therefore, Tissue Trauma sets in with the resultant tissue decay and ulcer formation. Movement of the individual into different positions helps in restoring blood circulation into the effected areas. Such movement is, however, not always possible or, in some instances, neglected.

Various devices are relied upon by medical personnel and the like in attempting to avoid the problem of decubitus ulcers in bedridden individuals. For instance, air overlays and mattresses (static and dynamic), water overlays and mattresses, gel-like overlays, specialty care beds and foam overlays have been introduced in an attempt to avoid the problem of decubitus ulcers.

The prior art foam overlays, although generally cheaper than specialty beds and less complicated than some of the water mattresses and overlays, suffer from many drawbacks including:

(1) insufficient pressure reduction, especially in the hip and heel area;

(2) poor body/foam conformance which can lead to poor weight distribution and the development of high pressure points;

(3) discomfort due to high density foam or easily "bottomed out" pads;

(4) the placement of the person too high above the underlying mattress so as to decrease the safety factor; and (5) high heat retention within the surface of the foam overlay.

SUMMARY OF THE INVENTION

The present invention provides a foam mattress overlay which retains the advantages of the prior art foam mattress overlays (e.g. ease of operation, manueverability and avoidance of complicated structure) while avoiding the above enumerated problems associated with prior art foam mattress overlays.

The foam mattress overlay of the present invention is in the form of a laminated mattress overlay having a base layer formed of a first type of polyurethane foam and an upper layer formed of a second type of polyurethane foam, the combination of which provides a flotation system which avoids high pressure points that can lead to the formation of ulcers. In other words, the two layers forming the laminated mattress overlay work in conjunction to provide improved flotation characteristics.

The upper layer is a high-resiliency densified urethane foam preferably having a density ranging between 2.3 to 2.7 lbs/ft$^3$. The upper layer is preferably affixed to the upper surface of the base layer by an adhesive and generally is less thick than the base layer. For example, a base thickness which is twice as thick as the upper layer has proven suitable for the purposes of the present invention.

In addition to having a higher density than the base layer, the upper layer also has a higher initial softness ratio than the base layer. The combination of high density and high initial softness ratio enables the more problematic body parts such as the heel to sink in to the foam before load resistance is encountered. This arrangement increases the body-to-foam contact area and spreads the weight of the body part over a greater area thereby reducing the pressure on the body part (e.g., heel).

The upper layer also has a lower indentation load deflection at the 5, 25 and 65% deflection points than the corresponding indentation load deflection values of said base layer.

To reduce the contact area while maintaining sufficient support, the upper layer preferably includes a plurality of depressions or recesses which can extend either only into said upper layer or, in a preferred embodiment, extend through said upper layer and partially into said base layer. The depressions are arranged so as to form a checkerboard-like surface in the upper layer.

A suitable polyurethane foam for forming the upper layer includes the polyurethane foam sold under the trademark OMALUX as described in U.S. Pat. No. 4,816,494 which is incorporated herein by reference.

The portions of the upper layer between the depressions are planar so as to provide an overall planar support surface on the top surface of the upper layer.

The bottom or base layer is formed of a polyurethane foam having a density ranging generally between about 1.80 to 2.00 lbs/ft$^3$ and a compression modulus of between 1.90 to 2.10. A suitable polyurethane foam material for forming the base layer includes H39XG foam which is a foam sold by E. R. Carpenter Company Inc. of Richmond, Va.

DETAILED DESCRIPTION OF A PREFERRED EMBODIMENT

Figure 1:
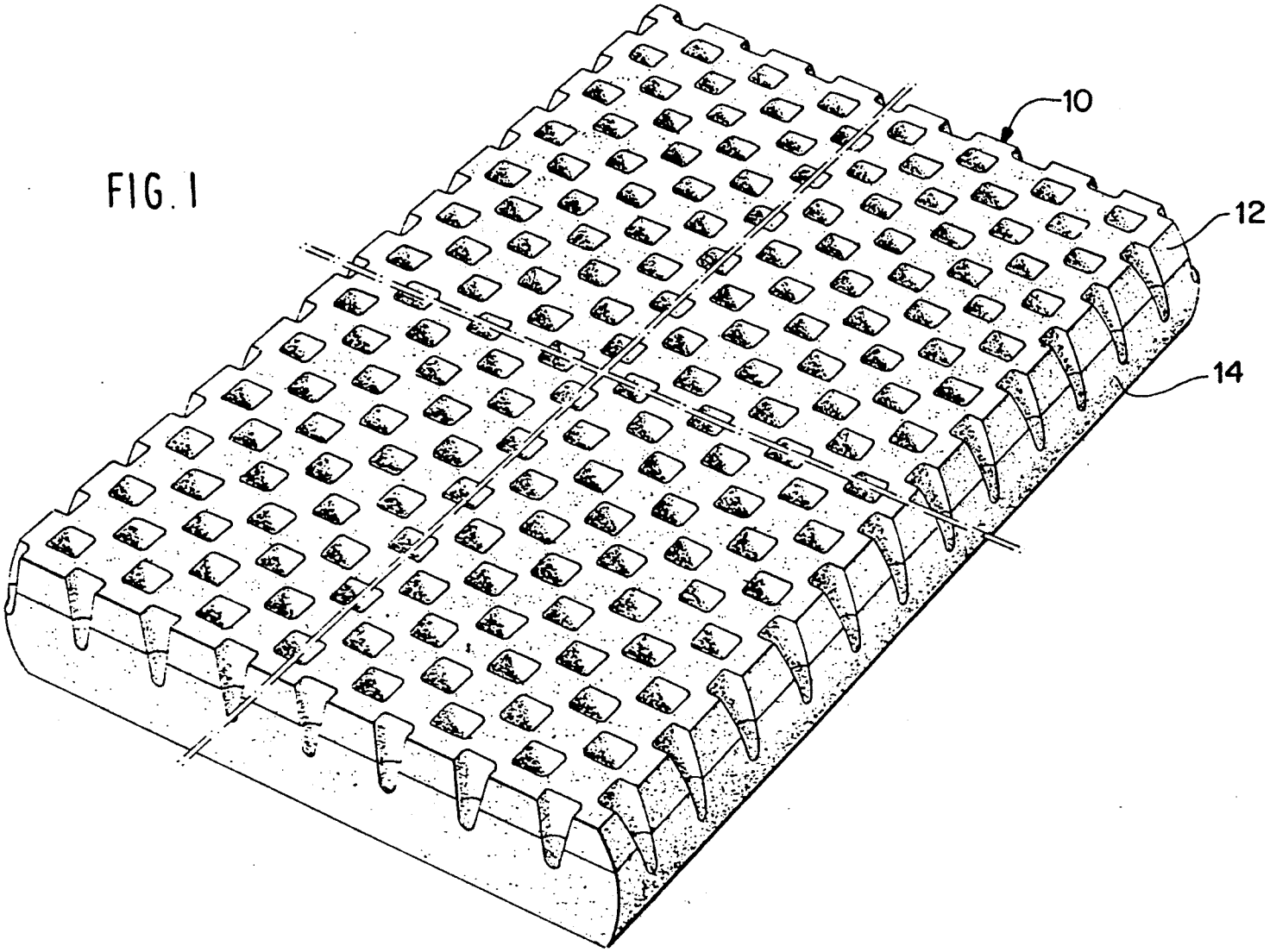
FIG. 1 illustrates a perspective view of a preferred embodiment of the present invention.
Figure 4:
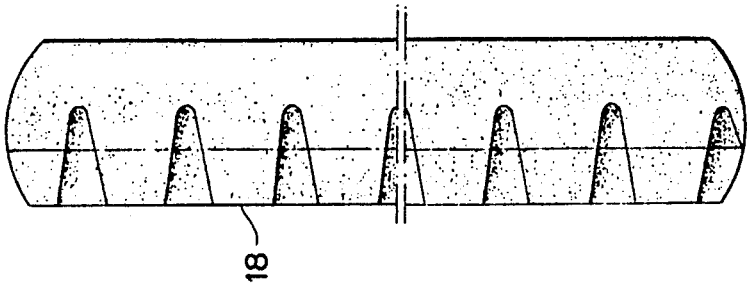
FIG. 4 shows an end view of the embodiment shown in FIG. 1.
Figure 2:
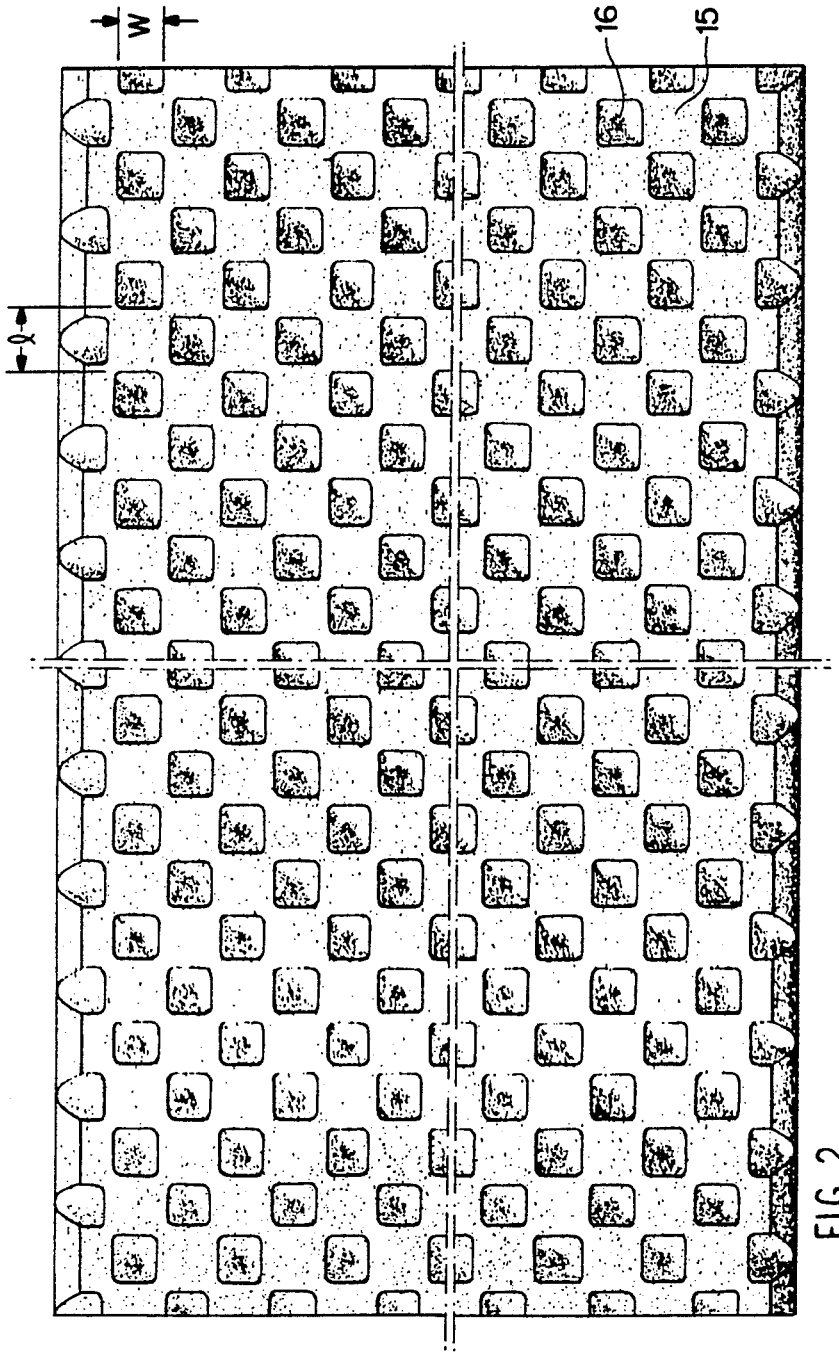
FIG. 2 shows a planar view of the embodiment shown in FIG. 1.

FIG. 1 shows, in perspective, a preferred embodiment of the present invention. As shown in FIG. 1, mattress overlay 10 includes an upper layer 12 affixed to the upper surface of base layer 14.

Both the upper layer and base layer are formed of a polyurethane foam material with the upper layer foam material being formed of a first type of polyurethane foam and the base layer being formed of a second type of polyurethane foam. The upper layer is preferably formed of a homogeneous polyurethane foam such as that described in U.S. Pat. No. 4,816,494. The density of the upper layer is higher than the density of the base layer and preferably within the range of about 2.0–2.7 lbs/ft$^3$ more preferably about 2.3–2.7 and even more preferably about 2.5 lbs/ft$^3$.

The material forming the upper layer also provides Indentation Load Deflection (ILD) values for 5, 25 and 65% deflection points which are lower than the corresponding ILD values for the base layer. The ILD value represents the amount of displacement force required to displace a pad a predetermined percentage (e.g. 5, 25 and 65%) of the pads' total thickness. Thus a foam pad having an ILD value of 14 for a deflection of 25% would require a load of 14 lbs to deflect a 4 inch thick pad 1 inch.

The upper layer of the present invention preferably has an ILD value that falls within the range of 4 to 9 for a deflection of 5% between 11 to 21 for a deflection of 25% and 30 to 70 for a deflection of 65%.

The upper layer also is formed so as to have an initial softness ratio which falls within the range of about 2.4 to 3.0. The softness ratio is determined by taking the ratio of the ILD value for 25% deflection over the ILD value for 5% deflection. In a preferred embodiment, the upper layer has a softness ratio of 2.7.

Moreover, the upper layer is designed to have a compression modulus which lies within the range of about 2.7 to 3.3. The compression modulus reflects the bottoming resistance of a pad is determined by the ratio of the foam layer's ILD value for 65% deflection taken over the ILD value for 25% deflection. In the present invention, a preferred compression modulus for the upper layer is about 2.9.

The base layer is formed of a second type of polyurethane foam having a density which is lower than that of the upper layer. For example, in a preferred embodiment the base layer is formed of a pad having a density falling within the range of about 1.8 to 2.0 and more preferably 1.8 to 1.9 lbs/ft$^3$.

The ILD values for 5, 25 and 65% are also higher for the base layer than that of the corresponding ILD values for the upper layer. The base layer is preferably formed of a foam material having a 5% ILD value falling between 26 to 38; a 25% ILD value falling between 39 to 49; and a 65% ILD value falling between 70 to 105. In the most preferred embodiment, the 5, 25 and 65% ILD value for the base layer is 6, 43 and 90, respectively.

Correspondingly, the initial softness ratio for the base layer falls between 1.3 to 1.5 and, most preferably, is about 1.4.

Also, the base layer is formed of a foam material exhibiting a compression modulus which falls within the range of 1.9 to 2.1 and, most preferably, is about 2.0.

Figure 5:
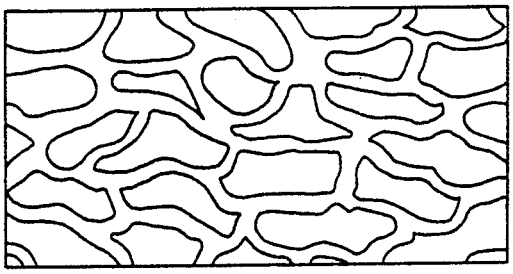
FIG. 5 shows a magnified view of a cross-section of the top layer shown in FIG. 1.

FIG. 5 of the present invention illustrates, somewhat schematically, a magnified view of the cell structure which the upper layer would have. The foam forming the upper layer is comprised of small elliptical cells which deflect to a high degree only under sufficiently high loading. The cellular configuration of the upper layer is thus able to provide a more uniform distribution of load. This plays an important role in helping to distribute the weight of body parts such as the hip and heel over a greater area so as to avoid high pressure points and the resultant tissue trauma which can occur.

Figure 6:
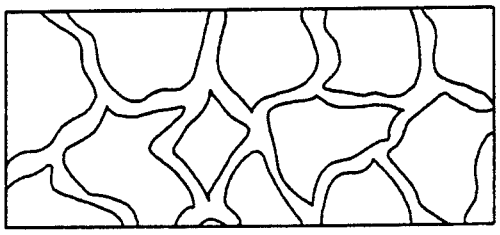
FIG. 6 shows a magnified view of a cross-section of the base layer shown in FIG. 1.

FIG. 6 illustrates, somewhat schematically, a magnified view of the cell structure for the base layer. This arrangement provides for the higher ILD values for the base layer with respect to the upper layer. The higher ILD firmness value for the base layer provides a complimentary arrangement with respect to the upper layer in that it provides the necessary relatively firm underlying foundation without degradation of the upper layer's initial softness ratio, body-to-pad conformance and enhanced load distribution.

Figure 3:
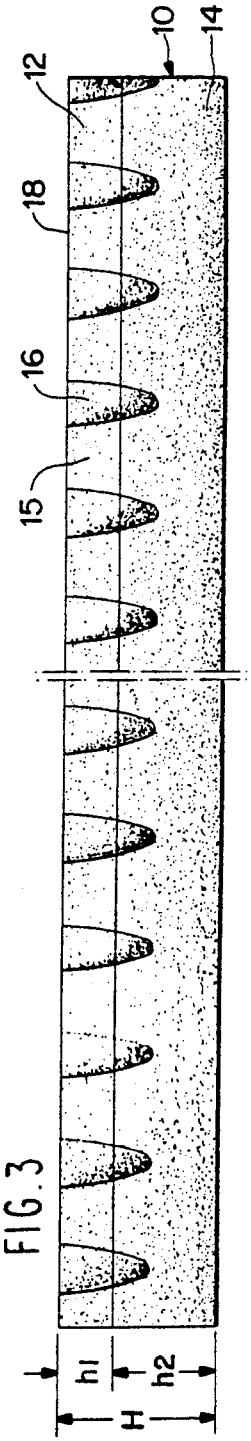
FIG. 3 a side view of the embodiment shown in FIG. 1.

Referring to FIG. 3, there is illustrated the respective thicknesses of the upper and base layers. As shown, the base layer is preferably made of greater thickness than that of the upper layer. In achieving the most complimentary relationship between the upper and base layer, it is preferable that the ratio of the base layer thickness $h_2$ over the upper layer thickness $h_1$ be within the range of about 1 $\frac{3}{4}$:1 $\frac{1}{4}$ to 2 $\frac{1}{4}$:$\frac{3}{4}$ and most preferably 2:1. This latter ratio is obtained by using the most preferred height value of 2" for $h_2$ and 1" for $h_1$ which results in the total thickness H of pad 10 being 3".

As shown in FIGS. 1–4, depressions 16 are formed so as to extend entirely through upper layer 12 and into base layer 14. Various arrangements are also contemplated such as the depressions extending only within upper layer 12. The embodiment most preferred, however, is that which is shown in FIGS. 1–4. Further, it is preferred to have the depressions extend into the base layer for between about 10 to 15% of the entire thickness $h_2$ of the base layer. In the most preferred embodiment, depressions 16 extend into base layer 14 an amount which is equal to 12% of $h_2$. The depressions are placed serially both along the length and width of the mattress overlay 10. The depressions are also spaced so as to place protruberances 15 in a checkerboard-like arrangement on the upper surface of the upper layer. This arrangement minimizes the surface contact between the body of the user and upper planar surface 18 of upper layer 12. The protruberances preferably constitute about 60% of the total planar surface. The protruberances also have a length (l)/width (w) configuration of about 1" to 1".

The depressions can be formed in any of the techniques common in the art including convoluted rollers, molding, heat slicing, punch disc, etc.

Figure 7:
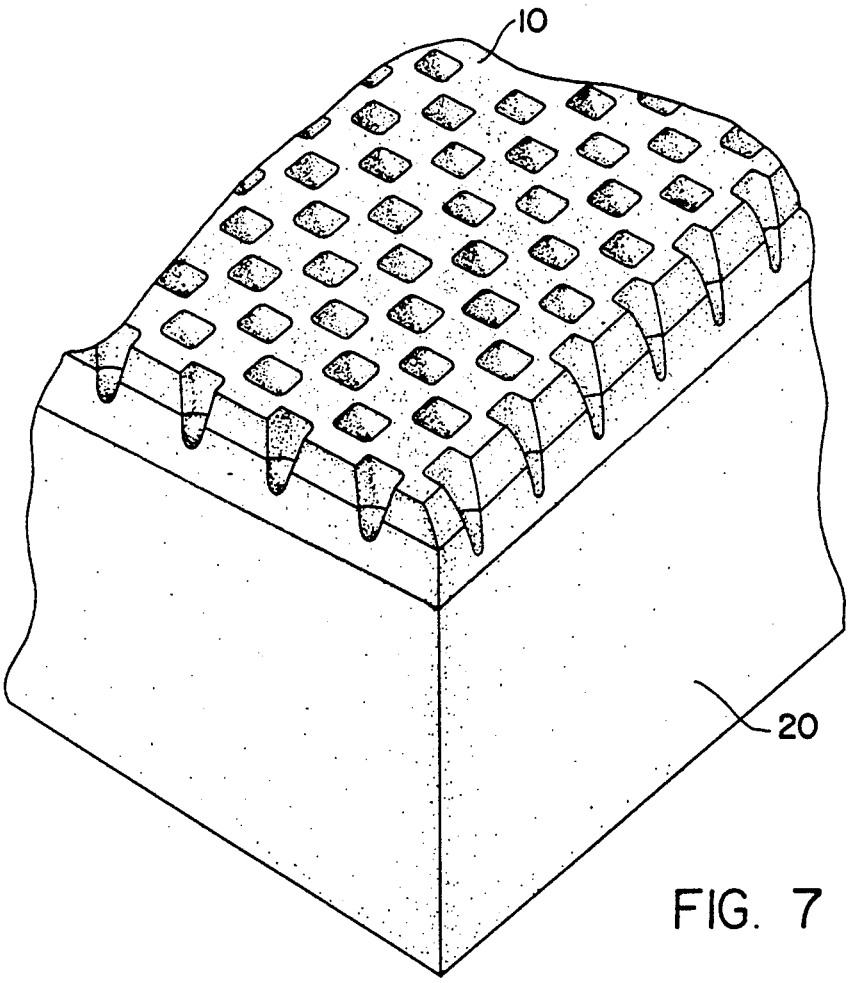
FIG. 7 shows a partially cut away perspective view of the present invention in position over a mattress.

FIG. 7 illustrates a partially cut away perspective view of mattress overlay 10 in position on a mattress 20. Preferably the width and length of the overlay is commensurate with, the width and length of the mattress.

To illustrate the advantages of the present invention over various foam pads in the prior art, the following tables containing test data are provided.

In Table I there is listed the results of a first test wherein various pressure area measurements were taken with respect to various body portions. The five foam mattress overlays tested had the following characteristics.

Pad #1: A laminated polyurethane foam pad having two layers of the same material and sold by the aforementioned E. R. Carpenter Company Inc. as R39XR form with the initial "R" representing an "in-house" code for density ranges which, in this case, refers to a density range of 1.4 to 1.5 lbs/ft$^3$. The "39" is in reference to the about 39 ILD at 25% defection value for the foam material The "X" in the code is an indication that the pad has been treated to avoid combustion, while the "R" at the end designates a red or pink color pad. Pad #1 had a total height of 3" with a base of 2". The total configuration of Pad 1 is 3×34×74 inches. This pad, as well as the remainder of the pads discussed below, were formed of a laminate with a 2" base and a 1" upper layer formed with a checkerboard-like configuration.

Pad #2: a polyurethane foam pad having the same configuration as pad 1 and having its base and upper layer both formed of E. R. Carpenter's H39XY foam with the "H", in this instance, designating a density range between 1.7 and 1.8 lbs/ft$^3$.

Pad #3 represents the present invention having the same structural configuration as pads #1 and #2 and formed of two different material as previously described.

Pad #4: A polyurethane foam pad having the same structure, configuration and formed of the same material as Pad #1 together with a protective sleeve cover comprising a polyurethane film 1 mm thick.

Pad #5: The present invention together with a polyurethane sleeve like that described above.

The test procedure, for which the results are tabulated in Table I, involved the placement by each of the pads described above over a common hospital mattress (King Koil Sleep Product—80"×35 ½×7 ½" with weight of 38 lbs). Pressure measurements were obtained with a Tally SciMedics hand held pressure meter (Model W-235) having a range of 20–3000 mm Hg. The hospital mattress and pads were placed on a sturdy table and subjects, which were selected according to specific weight ranges, were positioned on top. Shoes and pocket objects were removed by each subject prior to positioning themselves on the pad.

Five pressure areas were measured with two replications obtained with the results averaged and reported below. The five test areas were as follows:

1) Heel
2) Head
3) Scapula (Shoulder Blade)
4) Sacral Prominence (Tailbone)
5) Hip (Trochanter).

Precautions were taken to ensure the sensor was properly placed beneath the bony prominence corresponding to the above pressure areas.

The subjects weight and height are listed below:

A) 152 lbs—5'11"
B) 173 lbs—6'0"
C) 208 lbs—5'11".

TABLE I

| | PAD #1 | PAD #2 | PAD #3 | PAD #4 | PAD #5 |
|---|---|---|---|---|---|
| Heel | | | | | |
| A | 24.0 | 19.5 | 19.0 | 26.0 | 19.0 |
| B | 38.0 | 25.5 | 26.5 | 37.0 | 30.0 |
| C | 24.0 | 22.0 | 29.0 | 26.0 | 22.0 |
| Avg | 28.7 | 22.3 | 24.8 | 29.7 | 23.7. |
| Head | | | | | |
| A | 24.0 | 25.5 | 31.5 | 25.0 | 29.0 |
| B | 37.0 | 28.0 | 31.5 | 35.0 | 33.0 |
| C | 24.0 | 26.0 | 30.0 | 24.0 | 29.0 |
| Avg | 28.3 | 26.5 | 31.0 | 28.0 | 30.3 |
| Scapula | | | | | |
| A | 20.0 | 19.0 | 18.0 | 21.0 | 18.0 |
| B | 19.0 | 20.0 | 22.5 | 18.0 | 18.0 |
| C | 22.0 | 24.0 | 27.0 | 21.0 | 20.5 |
| Avg | 20.3 | 21.0 | 22.5 | 20.0 | 18.8 |
| Sacral Prominence | | | | | |
| A | 19.0 | 22.0 | 20.0 | 18.0 | 23.0 |
| B | 32.0 | 26.5 | 20.0 | 32.0 | 24.0 |
| C | 20.0 | 21.0 | 27.0 | 19.0 | 22.0 |
| Avg | 23.7 | 23.2 | 22.3 | 23.0 | 23.0 |
| Hip | | | | | |
| A | 56.0 | 43.5 | 37.0 | 55.0 | 43.0 |
| B | 48.0 | 47.5 | 45.0 | 48.0 | 39.5 |
| C | 48.0 | 43.5 | 42.0 | 47.0 | 40.5 |
| Avg | 50.7 | 44.8 | 41.3 | 50.0 | 41.0 |

*All values in mm Hg. - Average of two replications
**The readings represent an average for the three body types as defined in the Documenta Geigy, 6th Ed., 1962, "AVERAGE WEIGHT FOR ADULTS".

TABLE II below provides a comparison of the average pressure values obtained for each pad when all three weight classes are taken into consideration.

TABLE II

| | 1 | 2 | 3 | 4 | 5 |
|---|---|---|---|---|---|
| | Average of All Replications and Subjects Values in mm Hg | | | | |
| Heel | 28.7 | 22.3 | 24.8 | 29.7 | 23.7 |
| Head | 28.3 | 26.5 | 31.0 | 28.0 | 30.3 |
| Scapula (Shoulder Blade) | 20.3 | 21.0 | 22.5 | 20.0 | 18.8 |
| Sacral Prominence (Tailbone) | 23.7 | 23.2 | 22.3 | 23.0 | 23.0 |
| Hip (Trochanter) | 50.7 | 44.8 | 41.3 | 50.0 | 41.0 |

For comparison purposes, additional testing was conducted for Pad #4. The test procedure involved the use of a Tally Oxford Pressure Monitor (Model MKII). The subjects were all dressed in the same cotton sweat suits with no shoes and the mattress/pad combination was laid on the floor and the subjects were positioned on top of the mattress/pad combination. The mattress was of the same type used in the previous described tests.

The subjects weight and height are listed below:

A) 185 lbs 5'10"
B) 150 lbs 5'10"
C) 110 lbs 5'2".

Five pressure areas were measured with three replications obtained and the results averaged and reported below. The five test areas were as follows:

1) Heel
2) Head
3) Scapula (Shoulder Blade)
4) Sacral Prominence (Tailbone)
5) Trochanter (Hip).

The results of the test are set out in TABLE III with a summary of average results provided in TABLE IV.

TABLE III

| | Heel | Head | Scapula | Sacral Prominence | Trochanter |
|---|---|---|---|---|---|
| A | 23.0 | 25.0 | 22.0 | 22.0 | 37.0 |
| B | 14.0 | 19.0 | 14.0 | 25.0 | 41.0 |
| C | 23.0 | 27.0 | 21.0 | 43.0 | 43.0 |

TABLE III-continued

| | Heel | Head | Scapula | Sacral Prominence | Trochanter |
|---|---|---|---|---|---|
| Avg | 20.0 | 23.7 | 19.0 | 23.7 | 40.3 |

*All values in mm Hg - Average of three replications

TABLE IV

| | |
|---|---|
| Heel | 20.0 |
| Head | 23.7 |
| Scapula (Shoulder Blade) | 19.0 |
| Sacral Prominence (Tailbone) | 23.7 |
| Trochanter (Hip) | 40.3 |

Additional comparative testing was conducted between the following pads:

Pad #6: A pad having the same characteristics as Pad #2 (3"×34"×75" with weight of 8.2 lbs) except Pad #2 also featured a polyurethane sleeve like that described for Pad #4 and Pad #5.

Pad #7: A pad having the same characteristics as Pad #5.

Again a Tally Oxford Pressure Monitor (Model MKII) was used for evaluation.

The hospital mattress and pads were placed on the floor and subjects selected according to specific weight ranges, were positioned on top. The subjects were all dressed in the same cotton sweat suits with no shoes to ensure the proper placement of the sensor.

A) 185 lbs—5'10"

B) 110 lbs—5'2"

C) 170 lbs—5'10".

Five pressure areas were measured with three replications obtained and the results averaged and reported below. The five test areas were as follows:

1) Heel
2) Head
3) Scapula (Shoulder Blade)
4) Sacral Prominence (Tailbone)
5) Trochanter (Hip).

TABLE VI below illustrates the results of the tests conducted and TABLE VII provides a summary of the average results.

TABLE VI

| Subject | Pad #6 | Pad #7 |
|---|---|---|
| 185 lb - 5'10" | | |
| Heel | 21 | 11 |
| Head | 24 | 27 |
| Scapula | 22 | 26 |
| Sacral Prominence | 28 | 25 |
| Trochanter | 46 | 34 |
| 110 lbs - 5'2" | | |
| Heel | 21 | 18 |
| Head | 28 | 24 |
| Scapula | 25 | 24 |
| Sacral Prominence | 24 | 24 |
| Trochanter | 39 | 39 |
| 170 lbs - 5'10" | | |
| Heel | 20 | 22 |
| Head | 29 | 24 |
| Scapula | 20 | 20 |
| Sacral Prominence | 29 | 30 |
| Trochanter | 44 | 41 |

TABLE VII

| | Pad #6 | Pad #7 |
|---|---|---|
| Heel | 21 | 17 |
| Head | 27 | 25 |
| Scapula | 22 | 24 |
| Sacral Prominence | 27 | 26 |
| Trochanter | 43 | 38. |

As noted previously, the body areas extremely susceptible to the formation of decubitus ulcers include the hip and heel. The heel is especially difficult to maintain in low pressure contact state due to the heel's concentrated weight within a small area. The hip also is an area which is difficult to maintain in a low pressure state. The present invention provides a flotation system which is particularly successful in maintaining the hip and heel in a low pressure state. The present invention achieves this while maintaining both a comfortable and firm support.

The foregoing test results illustrate the ability of the present invention to maintain the hip and heel areas of the body in a low pressure state as compared to other foam pad arrangements and structural characteristics.

For instance, the results for the present invention (test Pads 3, 5 and 7) illustrate the lower values obtained in the hip and heel areas while the remainder of the pressure point areas are maintained at acceptably low levels.

The pads/sleeve combinations were tested to ensure that no detrimental effect on pressure reduction occurred when the sleeves were used. The sleeves in fact showed a slightly lower pressure reading which is felt to be the result of "hammocking" of the cover. The sleeve utilized on the present invention thus did not detract from the advantageous results obtained for the pad alone.

Although the preferred embodiment of the method and apparatus of the invention has been illustrated and described herein, it is intended to be understood by those skilled in the art that various modifications and omissions in form and detail may be made without departing from the spirit and scope of the invention as defined by the following claims.

What is claimed is:

1. A mattress overlay for avoiding decubitus ulcers, comprising:

a base layer of polyurethane foam material having a density between about 1.80 to 2.00 lbs/ft$^3$;

an upper layer affixed to an upper surface of said base layer, said second layer being formed of polyurethane foam and having a density between about 2.30 to 2.70 lbs/ft$^3$; and wherein said base layer has a 5% indentation load deflection between about 26 to 38, a 25% indentation load deflection between about 39 to 49 and a 65% indentation load deflection between about 70 to 105.

2. A mattress overlay as recited in claim 1 wherein said upper layer has a compression modulus ratio falling between 2.7:1 to 3.3:1.

3. A mattress overlay as recited in claim 2 wherein said base layer has a compression modulus ratio falling between about 1.90:1 to 3.3:1.

4. A mattress overlay as recited in claim 1 wherein said upper layer has an initial softness ratio of between about 2.4:1 to 3.0:1.

5. A mattress overlay as recited in claim 1 wherein the ratio between the thickness of said base to the thickness of said upper layer falls between about 1¾:1¼ to 2¼:¾.

6. A mattress overlay as recited in claim 1 wherein said upper layer has a 5% indentation load deflection between about 4 to 9, a 25% indentation load deflection between about 11 to 21 and a 65% indentation deflection between about 30 to 70.

7. A mattress overlay as recited in claim 6 wherein said upper layer has an initial softness ratio of between about 2.4:1 to 3.0:1.

8. A mattress overlay as recited in claim 6 wherein the ratio between the thickness of said base to the thickness of said upper layer falls between about 1¾:1¼ to 2¼:¾.

9. A mattress overlay as recited in claim 1 wherein said upper layer has a bottoming resistance of greater than 2.7.

10. A mattress overlay as recited in claim 1 wherein said upper layer has a compression modulus of 2.7 or more and said base layer has a compression modulus of less than 2.3.

11. A mattress overlay as recited in claim 1 wherein said upper layer features a plurality of depressions formed therein and said depressions being arranged so as to form a checkerboard-like upper surface.

12. A mattress overlay for avoiding decubitus ulcers, comprising:

a base layer of polyurethane foam material having a 5% indentation load deflection between about 26 to 38, a 25% indentation load deflection between about 39 to 49 and a 65% indentation load deflection between about 70 to 105;

an upper layer affixed to an upper surface of said base layer, said upper layer being formed of polyurethane foam having a 5% indentation load deflection between about 4 to 9, a 25% indentation load deflection between about 11 to 21 and a 65% indentation load deflection between about 30 to 70.

13. A mattress overlay as recited in claim 12 wherein said upper layer has a compression modulus ratio falling between 2.7:1 to 3.3:1 and said base layer has a compression modulus ratio falling between about 1.9:1 to 2.1:1.

14. A mattress overlay as recited in claim 12 wherein said upper layer has an initial softness ratio of between about 3.0:1 to 4.0:1.

15. A mattress overlay as recited in claim 12 wherein the ratio between the thickness of said base to the thickness of said upper layer falls between about 2 to 1.

16. A mattress overlay as recited in claim 12 wherein the ratio between the thickness of said base to the thickness of said upper layer falls between about 1¾:1¼ to 2¼:¾.

17. A mattress overlay as recited in claim 12 wherein said upper layer has a bottoming resistance of greater than 2.7.

18. A mattress overlay as recited in claim 12 wherein said upper layer has a compression modulus of 2.7 or more and said base layer has a compression modulus of less than 2.3.

19. A mattress overlay as recited in claim 12 wherein said upper layer features a plurality of depressions formed therein and said depressions being arranged so as to form a checkerboard-like upper surface.

20. A mattress overlay for avoiding decubitus ulcers, comprising:

a base layer formed of polyurethane foam;

an upper layer formed of polyurethane foam and affixed to an upper surface of said base layer;

said upper layer having a higher density and initial softness ratio than said base layer and said base layer being thicker than said upper layer.

21. A mattress overlay as recited in claim 20 wherein said upper layer has a compression modulus which is greater than or equal to 2.7 and higher than said base layer.

22. A mattress overlay as recited in claim 20 wherein said upper layer has a 5%, 25% and a 65% indentation load deflection which is lower in value than that of said base layer.

23. A mattress overlay as recited in claim 22 wherein said base layer is thicker than said upper layer by a ratio of between about 2 to 1.

24. A mattress overlay as recited in claim 20 wherein the bottoming resistance of said upper layer is higher than that of said base layer.

25. A mattress overlay as recited in claim 20 wherein said upper layer has a compression modulus of 2.7 or more and said base layer has a compression modulus of less than 2.3.

26. A mattress overlay as recited in claim 20 wherein said upper layer features a plurality of depressions formed therein and said depressions being arranged so as to form a checkerboard-like upper surface.

27. A mattress overlay for avoiding decubitus ulcers, comprising:

a base layer of polyurethane foam;

an upper layer of polyurethane foam having a higher density value than said base layer, said upper layer being secured to said base layer and having an upper support surface;

said mattress overlay having a plurality of depressions formed therein which are arranged in a checkerboard-like sequence and originate at said upper support surface and extend into said base layer.

28. A mattress overlay as recited in claim 27 wherein said base layer is 2 times thicker than said upper layer.

29. A mattress overlay as recited in claim 28 wherein said depressions extend into 10 to 15% of the total thickness of said base layer.

* * * * *